United States Patent [19]

Lavin et al.

[11] 4,231,894

[45] Nov. 4, 1980

[54] STABILIZED ALKALI METAL BISULFITE OR SULFITE-CATALYZED SOLUTIONS

[75] Inventors: Walter M. Lavin, Horsham; James I. McFarlane, Warminster; Dennis L. Rose, Fairless Hills, all of Pa.

[73] Assignee: Betz Laboratories, Inc., Trevose, Pa.

[21] Appl. No.: 112,981

[22] Filed: Jan. 17, 1980

Related U.S. Application Data

[60] Continuation-in-part of Ser. No. 929,157, Jul. 31, 1978, abandoned, which is a division of Ser. No. 807,949, Jun. 20, 1977, which is a continuation of Ser. No. 724,442, Sep. 20, 1976, abandoned.

[51] Int. Cl.[3] ..... C23F 11/18

[52] U.S. Cl. ..... 252/389 A; 210/699; 210/700; 422/15

[58] Field of Search ..... 210/57, 58, 59, 63 R; 252/180, 181, 389 A, 400 A; 422/15

[56] References Cited

U.S. PATENT DOCUMENTS

| | | | |
|---|---|---|---|
| Re. 28,553 | 9/1975 | Van Freyhold | 422/15 |
| 3,214,454 | 10/1965 | Blaser | 260/438.1 |
| 3,431,217 | 3/1969 | Hwa | 422/15 |
| 3,487,018 | 12/1969 | Troscinski | 252/389 A |
| 3,617,576 | 11/1971 | Kerst | 210/58 |
| 3,630,938 | 12/1971 | Troscinski | 252/389 A |
| 3,873,465 | 3/1975 | Di Simone | 422/15 |
| 3,890,228 | 6/1975 | Hwa | 210/58 |
| 3,899,293 | 8/1975 | Bush | 422/15 |

FOREIGN PATENT DOCUMENTS

| | | | |
|---|---|---|---|
| 1598044 | 8/1970 | France | 210/58 |

*Primary Examiner*—Ernest G. Therkorn

*Attorney, Agent, or Firm*—Alexander D. Ricci; Steven H. Markowitz

[57] ABSTRACT

The present invention is directed to a method of stabilizing aqueous solutions containing alkali metal sulfite or bisulfite and a catalyst therefor. The catalyzed sulfites which are of primary concern in the present instance are those which are used to inhibit or control oxygen corrosion in water treatment, particularly boiler water treatment.

15 Claims, No Drawings

STABILIZED ALKALI METAL BISULFITE OR SULFITE-CATALYZED SOLUTIONS

This application is a continuation-in-part application of Ser. No. 929,157 filed July 31, 1978, now abandoned, which is a divisional application of co-pending application Ser. No. 807,949 filed June 20, 1977, which is a continuation of Ser. No. 724,442 filed Sept. 20, 1976 and now abandoned.

BACKGROUND OF THE INVENTION

As described quite thoroughly on Pages 166 through 169 of the *Betz Handbook of Industrial Water Conditioning,* 6th Edition, 1962, Betz Laboratories, Inc., Trevose, Pa., the control of dissolved oxygen in water systems, particularly boiler water or more generally steam producing systems, is a must because of its capacity to promote the corrosion of metallic parts in contact with the water.

Dissolved oxygen can be introduced into the system not only in the makeup water but also due to air infiltration of the condensate system. When dissolved oxygen is present in the feedwater, an attack of the feed line, closed heaters and economizer can be expected with the severity of the problem dependent on the concentration of dissolved oxygen and the temperature involved. One of the most serious aspects of oxygen corrosion is that it generally occurs as pitting so that the attack is concentrated in a small area of the total metal surface. With this type of corrosion, failures can occur even though only a relatively small portion of the metal has been lost.

The influence of temperature on the corrosivity of dissolved oxygen is particularly important in such equipment as closed heaters and economizers where the water temperature is increased very rapidly. Under such conditions, an additional driving force for the oxidation reaction is present and for this reason, even very small quantities of dissolved oxygen in feedwater can cause severe corrosion in such equipment.

When oxygen is present in the feedwater entering the boiler, a portion will be flashed and will leave the boiler with the steam. The remainder of the dissolved oxygen can attack the boiler metal. While the point of attack will vary with the boiler design and feedwater distribution, oxygen pitting is usually concentrated adjacent to the water level in the feedwater drum.

The first and most important step in eliminating the corrosive influence of dissolved oxygen is mechanical deaeration of the boiler feedwater. Efficient deaeration will reduce the dissolved oxygen content of the boiler feedwater to a very low value. It is advisable to follow mechanical deaeration by chemical deaeration in order to remove the last traces of dissolved oxygen. Where mechanical deaeration is not employed, chemical deaeration must be used for the removal of the entire oxygen content of the feedwater.

Sodium sulfite and sodium bisulfite are the chemical agents most commonly employed for chemical deaeration due to their low cost, ease of handling and their lack of scale forming properties. The oxygen scavenging characteristics of sodium sulfite are illustrated by the following reaction:

$$2Na_2SO_3 + O_2 = 2Na_2SO_4$$

(sodium sulfite + oxygen = sodium sulfate)

The reaction with sodium bisulfite is of course quite similar,

The removal of 1.0 ppm dissolved oxygen theoretically requires 7.88 ppm of chemically pure sodium sulfite. However, use of a technical grade of sodium sulfite or bisulfite combined with handling and blowdown losses as encountered in actual plant operation usually requires the feed of approximately 10 pounds of sodium sulfite or bisulfite for each pound of oxygen. Requirements will also depend on the concentration of excess sulfite maintained in the boiler water.

To assure complete oxygen removal, it is necessary to maintain a residual concentration of sulfite in the boiler water. The residual required depends on a number of factors such as the method of feed and the point of application, the dissolved oxygen concentration and the variation in the dissolved oxygen concentration of the feedwater.

Continuous feed of the sodium sulfites is generally required for complete oxygen removal. In the majority of plants, the most suitable point of application is the storage compartment of the deaerating or open heater. In other plants, sufficient reaction time will be allowed with application to the suction side of the boiler feed pump. While intermittent application is generally not recommended, it has been found in some low pressure systems that adequate protection is provided as long as the additions of sodium sulfite are made with sufficient frequency to continuously maintain the proper residual concentration in the boiler water.

Testing of the boiler water for sulfite residual and recording the quantity of sulfite required serves also as a quick check on heater deaeration efficiency in those plants where the oxygen content of the feedwater is not determined regularly. Any decrease in boiler water sulfite residual, and consequent need for increased feed of the sodium sulfites, is an indication that heater operation should be checked to ascertain and correct the reason for increased oxygen content of the boiler feedwater.

The speed of the sulfite-oxygen reaction is affected by a number of factors, the most important being temperature. The reaction time decreases with increased temperature. In general, the reaction speed doubles for every 10° C. increase in temperature. At temperatures of 212° F. and above the reaction is quite rapid. It has also been found that the presence of an excess or overfeed of the sodium sulfites will increase the reaction rate. Several investigators have shown that the reaction proceeds most rapidly at pH values in the vicinity of 9.0–10.0.

Research directed toward increasing the speed of the oxygen-sulfite reaction has determined that certain water-soluble materials act as catalysts in speeding this reaction to completion. The most suitable catalysts are the heavy metal cations of two or more valences. Iron, copper, cobalt, nickel and manganese are among the more effective catalytic aids to the oxygen-sulfite reaction. Combinations of several of these heavy metal cations have proved effective in providing a continuously active influence on the speed of reaction. The catalysts are introduced as their water-soluble salts, i.e., chloride, sulfate, nitrate, etc.

As a result of research on catalytic aids for oxygen removal, catalyzed sodium sulfite and sodium bisulfite formulations were developed. Through the incorporation of suitable catalysts and the sodium sulfites in one formulation, a material was available which would consistently provide practically instantaneous oxygen removal, even when the water possesses natural inhibitory properties. The concentration of the catalyst added is dependent upon the sulfite concentration in the solution. Concentrations of the catalyst of 0.05 to 1.0% by weight of the weight of sulfite present have been found to be effective. Most commonly, the weight used is approximately 0.1%.

Catalyzed sodium sulfite or bisulfite is used in low temperature systems for oxygen removal and also finds application in boiler systems where the feedwater temperature is low, where mechanical deaeration is not complete or where it is essential to obtain rapid reaction for prevention of pitting in feed lines, closed heaters and economizers.

As indicated in the foregoing discussion, the use of catalysts in conjunction with the sodium sulfite and bisulfite has proven quite effective. However, there is a problem associated with aqueous solutions of these products, particularly aqueous solutions of sodium bisulfite, which occurs during storage in storage tanks. Unusual as it may seem, the problem did not occur when the product was contained for example in drums. It was discovered that at several locations having an aqueous solution containing 33% sodium bisulfite and 0.1% cobalt chloride catalyst (based on weight of bisulfite) stored in large bulk tanks the solution contained a reddish brown sludge which resulted in clogged feed lines and pumps, causing shutdowns.

Samples of the reddish brown sludge were analyzed and found to be composed of cobalt sulfite. Retained samples of the solution showed no evidence of any precipitation even in samples over two years old.

It was accordingly concluded that the products evidencing precipitation had been subjected to conditions during bulk storage which promoted the instability of the sodium bisulfite/cobalt chloride solution.

Since the precipitation of $CoSO_3$ occurred only in vented bulk storage tanks, it was assumed that the loss of sulfur dioxide gas from the cobalt catalyzed bisulfite solution was a critical factor in the precipitation. The decrease in the concentration of $NaHSO_3$ in the complaint samples could be attributed to the evolution of sulfur dioxide gas. This explained the pH rise in the sludged samples, since bisulfite solutions evolve sulfur dioxide according to the reaction:

$$2HSO_3 \longrightarrow SO_2\uparrow + H_2O + SO_3=$$

The net reaction results in the loss of two bisulfite protons to water and the formation of a sulfite ion. The pH and sulfite ion concentration of an open air bisulfite solution rises as sulfur dioxide is evolved. The increase in the sulfite ion concentration accompanying the evolution of $SO_2$ gas leads to formation of cobalt sulfite.

This mechanism was proved in the laboratory by dividing a sodium bisulfite/cobalt chloride solution into two jars. One jar was vented with a small hole in the lid while the other was tightly sealed. The starting pH was 3.2. Over a period of one month the sealed jar maintained its pH of 3.2. The pH of the solution in the vented jar rose to 5.1 and a red precipitate of cobalt sulfite formed on the bottom of the jar. The sulfite ion concentration of a bisulfite solution was also increased by addition of enough caustic to raise the pH from 3.8 to 5.0. The precipitation of cobalt sulfite occurred overnight.

Applicants considered, but quickly eliminated, solutions to the problem proposed including mechanical adjustments to the tanks, addition of acid in the field to maintain a low pH, and replacement of the catalyst with one more stable under higher pH.

GENERAL DESCRIPTION OF THE INVENTION

In performing research directed to the problem it was concluded that since the cobalt ion is soluble in the bisulfite solution at low pH, i.e., 3.5 or less, and precipitates as a sulfite salt at high pH's, i.e., above 4.3, an attempt would be made to utilize a stabilizing agent, perhaps even a chelating agent, which would not make the cobalt ion available under increasing pH conditions.

It was discovered that if a stabilizing amount of certain and only certain compounds was added to a bisulfite/cobalt solution which was likely to undergo an increase in pH to eliminate the formation of the precipitate cobalt sulfite, the cobalt remained in solution under increasing pH conditions and the cobalt's performance as a catalyst was not affected. It was also discovered that although some compounds did indeed effectively inhibit the formation of precipitate at increasing pH's, the effectiveness of the cobalt was retarded. The materials which were found to be effective and which are the subject of this application were those depicted by the formula:

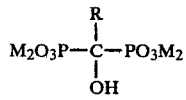

where R is an alkyl of from about 1 to 3 carbon atoms, and M is preferably hydrogen but may be sodium, potassium or ammonium. The derivative of the above formula which was found to be particularly effective for the purpose was where R represented a methyl group and M was hydrogen. The name of the compound is hydroxy ethylidene diphosphonic acid.

The amount of stabilizing agent necessary is a function of the cobalt ion concentration in the aqueous solution of sodium bisulfite. The tests conducted indicated that an amount ranging from a stoichiometric amount to about four (4) moles of stabilizing agent for each mole of catalyzing metal ion would be most effective from an efficacy point of view as well as an economic one. The preferred amount of course is the least that is required to perform the function, which is in most cases in the proximity of a stoichiometric amount. The individual ingredients are all water-soluble and accordingly the composition can be made by simple blending operations.

For example, to a mixture comprising on a weight basis 33% sodium bisulfite, 0.1% cobalt chloride, and 66.9% water is added sufficient hydroxy ethylidene diphosphonic acid (0.18% by weight) to produce a mole ratio of phosphonic acid stabilizer to cobalt ion of 1.13:1.0. Water is then added to produce an easily fed compositional solution.

Although the foregoing is the case in most instances, certain precautions must be observed; if the catalyst is to be added to a sulfite or bisulfite solution where the pH is already or is likely to be above 4.3 (i.e., the addition of dry catalyst and sulfite powders to water) it is preferable to add the phosphonic acid compound prior to addition of the cobalt catalyst. Reverse order can cause precipitation problems which can not be rectified by the addition of the phosphonic acid.

TESTING

Various materials were tested to establish each one's efficacy in stabilizing cobalt chloride catalyzed bisulfite solutions. These materials were added in various concentrations to 100 gram lots of aqueous solution of sodium bisulfite/cobalt chloride (33%+0.1%+66.9%) contained in uncapped bottles. The samples bearing the added materials together with standard samples (untreated) were kept at 100° F. for 72 hours in open air. It was determined that under these conditions the untreated bisulfite/cobalt solution would undergo precipitate formation.

The test results were as follows:

TABLE 1

| Stabilizer Added | % By Weight | Stabilizer Molar ratio/$Co^{+2}$ | Initial pH | Appearance 72 hours | Final pH |
|---|---|---|---|---|---|
| FIRST SERIES | | | | | |
| Blank | — | — | 3.5 | Red precipitate | 5.1 |
| EDTA $Na_4$ | 1.0 | 3.5-1 | 3.6 | Clear tan solution | 5.1 |
| Sulfamic acid | 0.5 | 6.7-1 | 3.4 | Red precipitate | 5.1 |
| Nitrilo tri (methylene phosphonic acid) | 0.5 | 2.17-1 | 3.3 | Clear purple solution | 5.1 |
| Hydroxyethylidene diphosphonic acid | 0.6 | 3.78-1 | 3.3 | Clear purple solution | 5.1 |
| Hexamethylene diamine (tetramethylene phosphonic acid) | 0.5 | 1.32-1 | 3.4 | Red precipitate | 5.1 |
| Ethylenediamine | 0.5 | 10.8-1 | 3.6 | Red precipitate | 5.1 |
| Morpholine | 0.5 | 7.5-1 | 3.6 | Red precipitate | 5.1 |
| Triethanolamine | 0.5 | 4.4-1 | 3.6 | Red precipitate | 5.1 |
| Ammonium Hydroxide | 0.5 | 7.0-1 | 3.6 | Red precipitate | 5.1 |
| Pentaethylenehexamine | 0.5 | 2.77-1 | 3.6 | Clear tan solution | 5.1 |
| SECOND SERIES | | | | | |
| Blank | — | — | 3.8 | Red precipitate | 5.1 |
| Hydroxyethylidene diphosphonic acid | 0.3 | 1.89-1 | 3.7 | Clear purple solution | 5.1 |
| Nitrilo tri (methylene phosphonic acid) | 0.25 | 1.08-1 | 3.7 | Red precipitate | 5.1 |
| Pentaethylenehexamine | 0.2 | 1.10-1 | 3.9 | Clear tan solution | 5.1 |
| EDTA $Na_4$ | 0.4 | 1.39-1 | 3.9 | Clear tan solution | 5.1 |
| THIRD SERIES | | | | | |
| Blank | — | — | 3.7 | Red precipitate | 5.1 |
| Hydroxyethylidene diphosphonic acid | 0.18 | 1.13-1 | 3.6 | Clear purple solution | 5.1 |
| Pentaethylenehexamine | 0.1 | 0.55-1 | 3.8 | Red precipitate | 5.1 |
| EDTA $Na_4$ | 0.3 | 1.05-1 | 3.8 | Red precipitate | 5.1 |
| FOURTH SERIES | | | | | |
| Blank | — | — | 3.0 | Red precipitate | 5.1 |
| Hydroxyethylidene diphosphonic acid | 0.12 | 0.75-1 | 2.9 | Red precipitate | 5.1 |

The foregoing data illustrate conclusively that the phosphonic acid compound was effective for the purpose. It is apparent that certain other compounds, e.g., amines and acetic acid derivatives, were also found to be effective to a certain extent; however, upon subsequent testing as described below their use was eliminated.

In order to assure that product effectiveness was not hindered by the addition of the stabilizers, product effectiveness tests were performed on experimental boilers. These tests established that the addition of the phosphonic acid compound did not hinder the catalyzing effect of a cobalt catalyzed bisulfite. In fact, preliminary tests concluded that the oxygen uptake was accelerated. The presence of the stabilizing agent appeared to enhance the catalytic effect of cobalt. However, this was not the case with pentaethylenehexamine, the tetra sodium salt of ethylenediamine tetraacetic, or the tri sodium salt of nitrilo triacetic acid. Upon testing it was determined that these stabilizers in fact retarded oxygen uptake and accordingly were concluded to be unsuitable. Another amine, however, was found to be satisfactory as a stabilizer and also did not retard oxygen uptake. This material is the subject of a separate application.

As indicated earlier, catalysts containing metal cations such as iron, copper, nickel and manganese have also been used successfully. In order to establish the efficacy of the subject phosphonic acid as a stabilizer, tests similar to those aforedescribed under the heading "Testing" were conducted using catalysts of iron, manganese, nickel and copper. Copper presented no problems from a precipitation standpoint, however, the iron, manganese and nickel catalysts did indeed precipitate when pH was increased. However, the addition of the subject phosphonic acid did not alleviate this problem. Consequently, it was evident that the stabilization was peculiar to the phosphonic acid compound in conjunction with a cobalt catalyst.

A series of tests were conducted to compare the oxygen uptake efficacy of the pentasodium salt of nitrilo trimethylenephosphonic acid with hydroxyethylidene diphosphonic acid. U.S. Pat. No. 3,899,293 to Bush discloses in Example III that the pentasodium salt of nitrilo trimethylenephosphonic acid (DEQUEST 2005) was tested and drastically reduced the rate of oxidation of sodium sulfite in the presence of cobalt catalyst.

The tests involved the removal of dissolved oxygen from water at 78° C. with cobalt-catalyzed sodium sulfite containing either DEQUEST 2005 or 1-hydroxyethylidene-1,1-diphosphonic acid (DEQUEST 2010). The procedure used was substantially as follows:

1. A solution containing 10% by weight of technical grade sodium sulfite was prepared.

2. To three 100 gram aliquots of this solution were added sufficient quantities of hydrated cobaltous sulfate to yield solutions containing 1 ppm of divalent cobalt.

3. To one of these solutions was added 0.6% solid DEQUEST 2005 (100% active).

4. To another solution was added 1% liquid DEQUEST 2010 (60% active) which resulted in a solution which was 0.6% with respect to the active material in DEQUEST 2010.

5. No DEQUEST materials were added to the third solution.

6. All three solutions were stored in sealed glass bottles prior to use.

7. Demineralized water which had been sparged with nitrogen to attain the desired dissolved oxygen content and to which had been added sodium hydroxide for adjustment of pH was heated to a specific temperature in a once-through flow system.

8. To the hot flowstream, test solutions were injection fed at a precisely controlled rate.

9. The flowstream was then cooled, and dissolved oxygen was monitored at a point 240 seconds downstream of the injection point using a dissolved oxygen flow cell.

The results of these tests are reported below in Table 2 in terms of percent oxygen removed from test solution.

TABLE 2

Temperature = 78° ± 3° C.
Pressure = 3-5 psig
Flow Rate = 300 ml/min.
Feed Rate = 0.13 ml/min.
Reaction Time = 240±10 seconds

| Treatment | pH During Reaction | Chemical Feed (ppm $SO_3$=) | Initial $O_2$ (ppm) | Final $O_2$ (ppb) | % $O_2$ Removed |
|---|---|---|---|---|---|
| None | 9.5 | 28 | 2.5 | 45 | 98 |
| None | 9.4 | 27 | 2.0 | 35 | 98 |
| DEQUEST 2005 | 9.4 | 28 | 2.0 | 750 | 63 |
| DEQUEST 2005 | 9.7 | 28 | 1.5 | 650 | 57 |
| DEQUEST 2010 | 9.4 | 28 | 2.0 | 40 | 98 |
| DEQUEST 2010 | 9.7 | 28 | 1.5 | 40 | 97 |

As can be seen from Table 2, cobalt-catalyzed sodium sulfite solution containing no phosphonic acid compound was found to remove 98% of the oxygen from the test water. The cobalt-catalyzed sodium sulfite solution containing DEQUEST 2010 also removed about 98% of the oxygen from the test water. Thus, it can be seen that the DEQUEST 2010 had no adverse effect on the oxygen uptake efficacy of the oxygen scavenger. However, cobalt-catalyzed sodium sulfite solution containing DEQUEST 2005 removed only 63% and 57% of the oxygen from the test water. Thus, it can be seen that the DEQUEST 2005 drastically reduced the oxygen uptake efficacy of the sodium sulfite in the presence of cobalt-catalyst.

Accordingly, having thus described our invention, what is claimed is:

1. A method for stabilizing during storage an aqueous solution of an alkali metal sulfite or bisulfite containing a water-soluble cobalt catalyst without affecting the catalytic effect of the cobalt catalyst, which solution with an increase of pH will experience the precipitation of said cobalt as its sulfite salt, said method consisting essentially of incorporating in said solution a stabilizing amount of a compound having the structural formula:

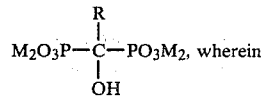

R is a lower alkyl of from 1 to 3 carbon atoms and wherein M is selected from the group of hydrogen, sodium, potassium and ammonium.

2. A method according to claim 1, wherein the cobalt catalyst is selected from the group consisting of cobalt chloride and cobalt sulfate.

3. A method according to claim 1, wherein said compound is added in an amount of 1 to 4 moles per mole of cobalt cation in the catalyst.

4. A method according to claim 3, wherein the cobalt catalyst is selected from the group consisting of cobalt sulfate and cobalt chloride.

5. A method according to claim 4, wherein said compound has the formula

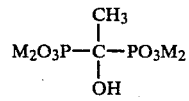

6. A method according to claim 5, wherein M is hydrogen.

7. A method according to claim 6, wherein the alkali metal sulfite or bisulfite is sodium sulfite or sodium bisulfite.

8. A method according to claim 1, wherein the amount of cobalt catalyst present is from about 0.05 to 1% by weight of the alkali metal sulfite or bisulfite, and said compound is incorporated in an amount of from about 1 mole to 4 moles per mole of metal catalyst.

9. A method according to claim 8, wherein the cobalt catalyst is selected from the group consisting of cobalt sulfate and cobalt chloride.

10. A method according to claim 9, wherein said compound has the formula

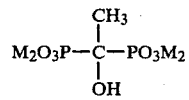

11. A method according to claim 10, wherein M is hydrogen.

12. A method according to claim 11, wherein the alkali metal sulfite or bisulfite is sodium sulfite or sodium bisulfite.

13. A method for stabilizing an aqueous solution of an alkali metal sulfite or bisulfite containing a water-soluble cobalt catalyst, which solution is being stored in a vented storage tank, said method comprising incorporating in said solution a stabilizing amount of a compound having the structural formula:

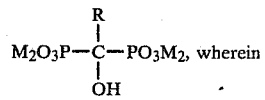

R is a lower alkyl of from 1 to 3 carbon atoms and wherein M is selected from the group of hydrogen, sodium, potassium and ammonium.

14. A method according to claim 13, wherein the pH of the solution is above 4.3.

15. A method according to claim 14, wherein said compound is added in an amount of 1 to 4 moles per mole of cobalt cation in the solution.

* * * * *